United States Patent [19]

Koike et al.

[11] Patent Number: 4,769,103

[45] Date of Patent: Sep. 6, 1988

[54] LABEL FEEDER

[75] Inventors: Seiji Koike; Izumi Matsushita, both of Shizuoka; Yasuo Inoue, Kawasaki; Hideki Hama, Machida, all of Japan

[73] Assignees: Tokyo Electric Co., Ltd.; Sony Corporation, both of Tokyo, Japan

[21] Appl. No.: 943,490

[22] Filed: Dec. 19, 1986

[30] Foreign Application Priority Data

Dec. 26, 1985 [JP] Japan ..... 60-296685

[51] Int. Cl.[4] ..... B65C 11/02; B65C 9/08

[52] U.S. Cl. ..... 156/384; 101/288; 156/584; 400/120

[58] Field of Search ..... 156/384, 584, DIG. 24, 156/DIG. 28; 101/288; 400/120

[56] References Cited

U.S. PATENT DOCUMENTS

| | | | |
|---|---|---|---|
| 2,522,224 | 9/1950 | Hedinger | 156/384 |
| 3,187,624 | 6/1965 | Lazinski | 353/36 |
| 3,193,431 | 7/1965 | Seifert | 156/384 |
| 3,580,779 | 5/1971 | Schreiver et al. | 156/384 |
| 4,264,396 | 4/1981 | Stewart | 156/384 |
| 4,402,424 | 9/1983 | Mattix | 156/584 |
| 4,432,830 | 2/1984 | Jue | 156/384 |
| 4,607,291 | 8/1986 | Oono | 358/286 |

*Primary Examiner*—Willard E. Hoag

*Attorney, Agent, or Firm*—Oblon, Fisher, Spivak, McClelland & Maier

[57] ABSTRACT

A label printer for printing data on a label attached on a long ground paper by means of a thermal head opposed to a platen. The label printer includes a ground paper feeder constituted of a drive roller and a pinch roller for sandwiching the ground paper therebetween. The drive roller stretches the ground paper with slip generated between the drive roller and the ground paper to peel off the printed label from the ground paper by means of a peeling plate and to issue the same. The surface of the drive roller is provided with a wear resistance to prevent wear of the drive roller and thereby to prevent change in the outer circumference of the drive roller. Accordingly, the ground paper may be stretched by the paper feeder under always fixed conditions, and the label may be reliably peeled off by the peeling plate.

10 Claims, 2 Drawing Sheets

LABEL FEEDER

FIELD OF THE INVENTION

The present invention relates to a label printer for printing data on a label attached on a long ground paper and thereafter peeling off the label from the ground paper for issuance, and more particularly to a label feeder for feeding the ground paper from a platen portion so as to peel off the data printed label.

BACKGROUND OF THE INVENTION

Generally, in this kind of label printer, a long ground paper on which a label is attached is fed by a platen, and data is printed on the label by a thermal head opposed to the platen. A peeling plate is located on a downstream side of the platen, and a ground paper feeder is located on a downstream side of the peeling plate, so that the ground paper may be stretched by the ground paper feeder, and thereby a data printed label may be peeled off by the peeling plate, thus issuing the data printed label.

The ground paper feeder includes a drive roller formed of rubber and a pinch roller formed of metal for pressing the ground paper onto the drive roller. The ground paper feeding speed at the ground paper feeder is set lower than the ground paper feeding speed at the platen, so as to reliably peel off the label from the ground paper at the peeling plate. Further, the ground paper stretching force at the ground paper feeder is set smaller than the ground paper holding force by the platen and the thermal head, so as to prevent slip of the ground paper between the platen and the thermal head and to secure a printing operation on the labels.

However, the above-mentioned prior art has the following shortcomings. As the ground paper feeding speed at the ground paper feeder is higher than the ground paper feeding speed at the platen portion, and the ground paper stretching force is smaller, there is generated slip between the drive roller and the ground paper. This causes wear at the portion of the drive roller that is in contact with the pinch roller through the ground paper since the drive roller is formed of rubber, which is less wear resistant. When the drive roller is worn, the outer circumference of the drive roller is reduced by the amount of wearing. As a result, the peripheral speed of the drive roller is decreased, and the ground paper holding force generated by the drive roller and the pinch roller is weakened. This in turn causes a problem such that the necessary speed and stretching force for peeling off the label cannot be obtained at the ground paper feeder and the label cannot be peeled off.

Further, the coefficient of friction between rubber and paper is about 0.4, and accordingly, such an increased coefficient of friction causes easy generation of a wearing powder of the rubber and the paper because of the slip therebetween. If the wearing powder is stacked in the device, there is increased a possibility of the wearing powder depositing on the ink ribbon or on the labels, thereby causing reduction in the printing quality.

OBJECTS OF THE INVENTION

It is a first object of the present invention to provide a label feeder which may reliably peel off the label and secure a normal issuing operation of the label.

It is a second object of the present invention to provide a label feeder which may prevent generation of wearing powder.

SUMMARY OF THE INVENTION

According to the present invention, the drive roller has a wear resistance at its outer surface. Therefore, while there is generated slip between the drive roller and the ground paper in stretching of the ground paper, the drive roller having a wear resistance is hardly worn. Accordingly, the ground paper is stretched under always fixed conditions, and thereby a reliable peeling operation of the label at the peeling portion may be obtained. Furthermore, because friction between the ground paper and the drive roller is reduced, the generation of wearing powder is reduced. Accordingly, it is possible to suppress deposition of the wearing powder onto the ink ribbon or the labels and thereby to prevent reduction in the printing quality.

DESCRIPTION OF PREFERRED EMBODIMENT

Figure 1:
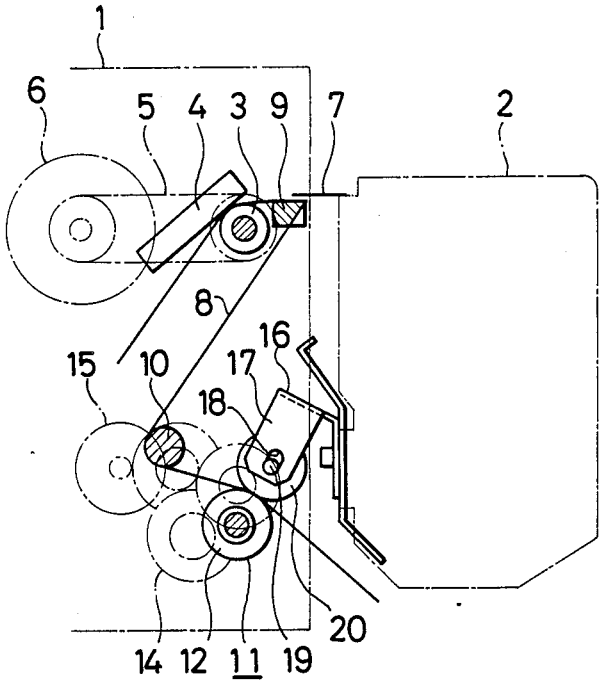
FIG. 1 is a vertically sectional side view of the platen area and the ground paper feeder in a preferred embodiment of the present invention.
Figure 2:
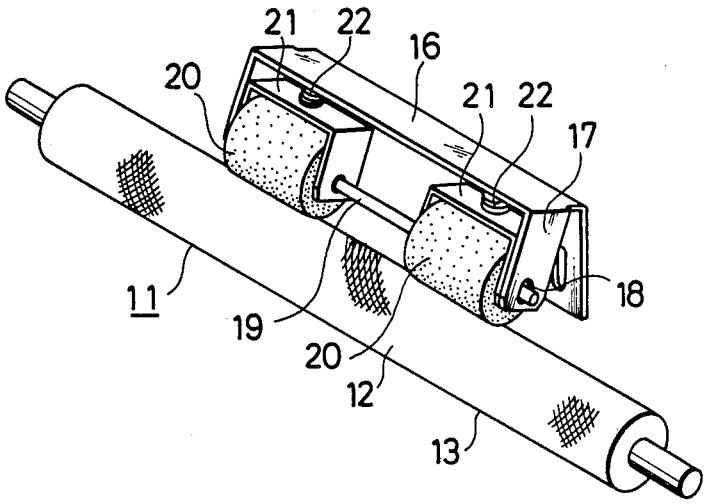
FIG. 2 is a perspective view of the ground paper feeder.
Figure 3:
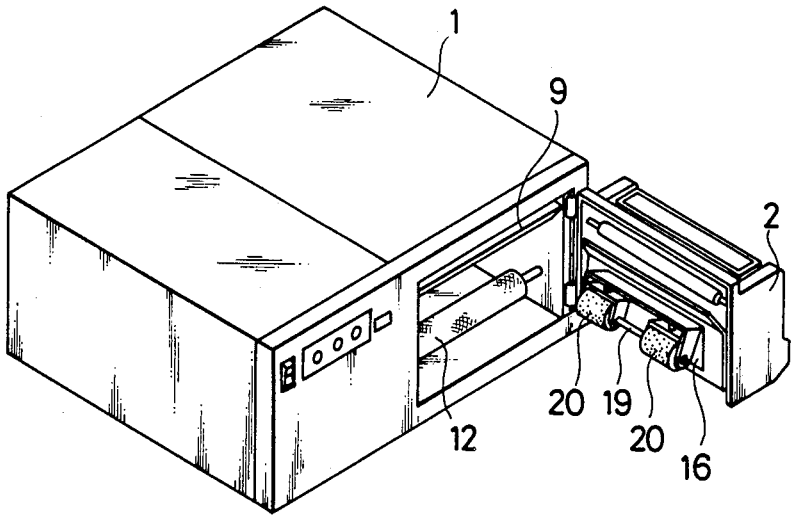
FIG. 3 is a perspective view of a label printer under an open condition of a label attaching device.

Referring to FIGS. 1 to 3, a label printer of the preferred embodiment is provided with a label attaching device 2 rotatably mounted at a front portion of a label printer body 1 by hinges.

A platen 3 is horizontally mounted in the label printer body 1, and a thermal head 4 is located over the platen 3 in such a manner as to be pressed under a fixed pressure by the platen 3. The platen 3 is connected through a belt 5 to a stepping motor 6.

A long ground paper 8 on which a plurality of labels 7 are attached is guided between the platen 3 and the thermal head 4. A peeling plate 9 is provided on a front side of the platen 3 so as to acutely bend the ground paper 8 and peel off the labels 7 from the ground paper 8. A drive roller 12 constituting a part of a paper feeding section 11 is horizontally mounted in the label printer body 1 at a lower portion thereof. The ground paper 8 bent by the peeling plate 9 is guided around a ground paper guide shaft 10 to the drive roller 12. The drive roller 12 is generally formed of a metal material, and it has a knurling 13 on its surface, thus forming a metal knurled roller. The drive roller 12 thus formed is connected through a plurality of drive gears 14 to a d.c. motor 15.

While the interior structure of the label attaching device 2 will not be described, it is such that each label 7 issued from the peeling plate 9 is attached onto an object (not shown). The label attaching device 2 is rotatably mounted on the front portion of the label printer body 1 as mentioned above. The label attaching device 2 includes a pair of pinch rollers 20 constituting the paper feeding section 11 in combination with the drive roller 12 under a set condition. A bracket 16 is mounted on an inside surface of the label attaching device 2 at a position opposite to the drive roller 12 in such a manner that the vertical position of the bracket 16 is adjustable. The bracket 16 is formed with opposed side support portions 17 having elongated holes 18. A support shaft 19 is movably engaged with the elongated holes 18. The pair of pinch rollers 20 and U-shaped frames 21 surrounding the pinch rollers 20 are mounted on the support shaft 19. The frames 21 are connected through compression springs 22 as an abutment spring to the bracket 16, so that the pinch rollers 20 are biased obliquely downwardly by the expansion force of the compression springs 22. The pinch rollers 20 are generally formed of rubber. The pinch rollers 20 are positioned in such a manner as to come into press-contact with the drive roller 12 with the ground paper 8 interposed therebetween.

In operation, the stepping motor 6 and the d.c. motor 15 are driven at the same time. The feeding speed of the ground paper 8 by the drive roller 12 connected to the d.c. motor 15 is set higher than the feeding speed of the ground paper 8 by the platen 3 connected to the stepping motor 6. However, the feeding speed of the ground paper 8 is dependent upon the peripheral speed of the platen 3, since the stretching force of the ground paper 8 at the ground paper feeding section 11 is set lower than the holding force of the ground paper 8 by the platen 3 and the thermal head 4. Accordingly, there is generated slip only between the drive roller 12 and the ground paper 8 upon feeding of the ground paper 8.

On the other hand, as the drive roller 12 is formed of metal, and has a superior wear resistance, it is hardly worn irrespective of the slip between the drive roller 12 and the ground paper 8. As a result, the ground paper 8 may be stretched under always fixed conditions at the ground paper feeding section 11, thereby obtaining a reliable peeling operation of the ground paper 8 by the peeling plate 9. Furthermore, as the slip between the drive roller 12 and the ground paper 8 is generated between metal and paper, and the coefficient of friction therebetween is a small value of about 0.2, not much wearing powder due to the friction therebetween is generated. Accordingly, there is little possibility of the wearing powder adversely affecting a printing portion, thus maintaining the printing quality in a good condition.

In addition, since the driving torque of the d.c. motor 15 is smaller than the driving torque of the stepping motor 6, the ground paper 8 is stretched by a torque at the drive roller 12 smaller than that at the platen 3. Therefore, after the drive roller 12 provides a fixed stretching force for the ground paper 8 from the peeling plate 9, there is not generated an excessive slip between the drive roller 12 and the ground paper 8 because of undue idling, but a moderate slip condition may be maintained. In prior-art devices, there are generated force components in the transverse direction of the ground paper 8 at rest because of difference in the pressing forces of the pinch rollers 20 in the transverse direction of the ground paper 8. The force components tend to be increased by the slip between the drive roller 12 and the ground paper 8, causing transverse slippage of the ground paper 8 accompanied by the feeding operation of the ground paper 8. To the contrary, in the preferred embodiment, since the slip of the drive roller 12 is moderate, the increase in the force components may be suppressed to the minimum. Accordingly, the transverse slippage of the ground paper 8 at the ground paper feeding section 11 may be prevented or at least greatly reduced, thereby securing a proper feeding operation of the ground paper 8. Such prevention or reduction of the transverse slippage of the ground paper 8 is also owing to the fact that the pinch rollers 20 are formed of rubber.

In addition, the moderate slip of the drive roller 12 to the ground paper 8 contributes to the prevention of generation of wearing powder from the ground paper 8 by the slip therebetween.

Although the drive roller 12 is formed of metal having a good wear resistance on its surface in the aforementioned preferred embodiment, the drive roller 12 may be formed of reinforced plastics, for example.

What is claimed is:

1. A label feeder comprising:

(a) a label printer body;

(b) a thermal head:

(i) mounted in said label printer body;

(ii) positioned to be pressed against a ground paper; and (iii) suitable for printing data on labels attached to the ground paper;

(c) a platen:

(i) rotatably mounted in said label printer body;

(ii) having a first coefficient of friction relative to the ground paper; and (iii) positioned to be pressed against the ground paper while the ground paper is interposed between said platen and said thermal head;

(d) first means mounted in said label printer body for peeling labels off the ground paper after the labels have been printed by said thermal head;

(e) a drive roller:

(i) rotatably mounted in said label printer body;

(ii) having a wear resistant surface; and (iii) having a second coefficient of friction relative to the ground paper that is less than the coefficient of friction between said platen and the ground paper;

(f) at least one pinch roller adapted to press the ground paper against said drive roller and to rotate in response to movement of the ground paper;

(g) a bracket having a plurality of elongated holes therein sized, shaped, and positioned to receive said support shaft and to permit said at least one pinch roller to move toward and away from said drive roller;

(h) at least one spring;

(i) to bias said at least one pinch roller towards said drive roller so that said at least one pinch roller presses the ground paper against said drive roller with at least approximately constant force regardless of wear to daid drive roller and to said at least one pinch roller and (ii) such that the force with which the ground paper is held between said drive roller and said at least one pinch roller is greater than the force with which the ground paper is held between said platen and said thermal head;

(i) second means for rotating said platen; and (j) third means for rotating said drive roller, said third means being such that torque on said drive roller is less than torque on said platen.

2. A label feeder comprising:

(a) a label printer body;

(b) a label attaching device mounted on said label printer body for pivotal movement back and forth between an operative position and an inoperative position;

(c) a thermal head:

(i) mounted in said label printer body;

(ii) positioned to be pressed against a ground paper; and (iii) suitable for printing data on labels attached to the ground paper;

(d) a platen;

(i) rotatably mounted in said label printer body;

(ii) having a first coefficient of friction relative to the ground paper; and (iii) positioned to be pressed against the ground paper while the ground paper is interposed between said platen and said thermal head;

(e) first means mounted in said label printer body for peeling labels off the ground paper after the labels have been printed by said thermal head;

(f) a drive roller:

(i) rotatably mounted in said label printer body:

(ii) having a wear resistant surface; and (iii) having a second coefficient of friction relative to the ground paper that is less than the coefficient of friction between said platen and the ground paper;

(g) at least one pinch roller mounted on a support shaft in said label attaching device in position to press the ground paper against said drive roller when said label attaching device is in its operative position;

(h) a bracket:

(i) mounted in said label attaching device and (ii) having a plurality of elongated holes therein sized, shaped, and positioned to receive said support shaft and to permit said at least one pinch roller to move toward and away from said drive roller when said label attaching device is in its operative position;

(i) at least one spring:

(i) to bias said at least one pinch roller towards said drive roller when said label attaching device is in its operative position so that said at least one pinch roller presses the ground paper against said drive roller with at least approximately constant force regardless of wear to said drive roller and to said at least one pinch roller and (ii) such that force with which the ground paper is held between said drive roller and said at least one pinch roller is greater than the force with which the ground paper is held between said platen and said thermal head;

(j) second means for rotating said platen; and (k) third means for rotating said drive roller, said third means being such that torque on said drive roller is less than torque on said platen.

3. A label feeder as recited in claim 2 wherein said first means is a peeling plate.

4. A label feeder as recited in claim 2 wherein said drive roller has a metal surface.

5. A label feeder as recited in claim 2 wherein said drive roller has a knurled surface.

6. A label feeder as recited in claim 2 wherein said drive roller has a reinforced plastic surface.

7. A drive roller as recited in claim 2 wherein:

(a) said drive roller has a cylindrical shape of uniform diameter and (b) said label feeder comprises a plurality of pinch rollers as recited in paragraph (g) of claim 2.

8. A label feeder as recited in claim 2 wherein:

(a) said at least one pinch roller is mounted in a frame;

(b) said frame is mounted in said bracket; and (c) said at least one spring bears at one end against said frame and at the other end against said bracket.

9. A label feeder as recited in claim 2 wherein said at least one pinch roller has a rubber surface.

10. A label feeder as recited in claim 2 wherein said at least one pinch roller has a coefficient of friction relative to the ground paper that is less than the coefficient of friction between the ground paper and said drive roller.

* * * * *